US012116767B2

(12) United States Patent
Blamble

(10) Patent No.: US 12,116,767 B2
(45) **Date of Patent: *Oct. 15, 2024**

(54) TILE FLOOR DRAIN

(71) Applicant: David Blamble, Bellevue, NE (US)

(72) Inventor: David Blamble, Bellevue, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/967,569

(22) Filed: Oct. 17, 2022

(65) Prior Publication Data

US 2023/0035222 A1 Feb. 2, 2023

Related U.S. Application Data

(60) Continuation of application No. 16/820,079, filed on Mar. 16, 2020, now Pat. No. 11,473,287, which is a division of application No. 15/097,041, filed on Apr. 12, 2016, now Pat. No. 10,604,925.

(60) Provisional application No. 62/146,347, filed on Apr. 12, 2015.

(51) Int. Cl.

| | |
|---|---|
| ***E03F 5/04*** | (2006.01) |
| ***E03C 1/22*** | (2006.01) |
| ***E03F 3/04*** | (2006.01) |

(52) U.S. Cl.

CPC ..... *E03F 5/0408* (2013.01); *E03C 1/22* (2013.01); *E03F 3/046* (2013.01); *E03F 5/0409* (2013.01)

(58) Field of Classification Search

CPC ..... E03F 3/046; E03F 5/0407; E03F 5/0408; E03F 5/0409; E03C 1/22

See application file for complete search history.

(56) References Cited

U.S. PATENT DOCUMENTS

| | | | | |
|---|---|---|---|---|
| 2,626,674 | A | 1/1953 | Boosey | |
| 4,739,524 | A | 4/1988 | Burd | |
| 4,845,914 | A | 7/1989 | Burd | |
| 10,604,925 | B2 * | 3/2020 | Blamble | E03F 5/0408 |
| 11,473,287 | B2 * | 10/2022 | Blamble | E03C 1/22 |
| 2010/0043136 | A1 | 2/2010 | Michael | |
| 2011/0047695 | A1 | 3/2011 | Niedens | |

(Continued)

OTHER PUBLICATIONS

"Final Office Action received for U.S. Appl. No. 15/097,041, mailed on May 14, 2018".

(Continued)

*Primary Examiner* — J C Jacyna

(74) *Attorney, Agent, or Firm* — Kutak Rock LLP; Ryan S. Hinderliter

(57) ABSTRACT

A tile drain and method of installing a tile drain is provided. The tile drain includes a drain body and a drain cover. The drain body defines a top opening, top weep apertures, and bottom weep apertures. The top opening receives the drain cover and serves as the primary drain for the tile drain. The top weep apertures are positioned below a top layer, such as a tile layer, of the base so as to receive fluid positioned between the top layer and a top waterproofing layer of the base. The sub weep apertures are positioned below the top waterproofing layer of the base so as to receive fluid positioned between the top waterproofing layer and a bottom waterproofing layer of the base. The drain body is encapsulated within the base, but the drain cover is adjustable relative to, and removable from, the drain body.

6 Claims, 15 Drawing Sheets

(56) References Cited

U.S. PATENT DOCUMENTS

| | | | | |
|---|---|---|---|---|
| 2011/0061161 | A1* | 3/2011 | Erlebach | E03F 5/0408 4/679 |
| 2011/0203979 | A1 | 8/2011 | Schlueter | |
| 2011/0303595 | A1 | 12/2011 | Larsson | |
| 2012/0036629 | A1* | 2/2012 | Cook | E03F 5/0407 4/613 |
| 2012/0110827 | A1 | 5/2012 | Doolittle et al. | |
| 2013/0276226 | A1* | 10/2013 | Cook | A47K 3/40 4/613 |
| 2016/0029853 | A1* | 2/2016 | Phillips | B25B 13/48 81/461 |
| 2016/0130794 | A1 | 5/2016 | Erlebach | |
| 2016/0270604 | A1 | 9/2016 | McLeod | |
| 2016/0298324 | A1 | 10/2016 | Blamble | |
| 2020/0217059 | A1 | 7/2020 | Blamble | |

OTHER PUBLICATIONS

"Final Office Action received for U.S. Appl. No. 16/820,079, mailed on Dec. 3, 2021.".
"Non Final Office Action Received for U.S. Appl. No. 15/097,041 mailed on Dec. 7, 2018, 10 Pages.".
"Non Office Action Received for U.S. Appl. No. 15/097,041 , mailed on Sep. 5, 2017.".
"Non Office Action Received for U.S. Appl. No. 16/820,079 , mailed on Apr. 28, 2021.".
"Notice of Allowance Received for U.S. Appl. No. 15/097,041, mailed on Nov. 26, 2019, 5 pages.", 5.
"Notice of Allowance received for U.S. Appl. No. 16/820,079, Mailed on Jun. 16, 2022.".
Blamble, David , "Final Office Action received for U.S. Appl. No. 15/097,041, mailed on Aug. 12, 2019,6 Pages", 6.

* cited by examiner

TILE FLOOR DRAIN

CROSS-REFERENCE TO RELATED APPLICATIONS

This application is a continuation application of U.S. patent application Ser. No. 16/820,079, filed Mar. 16, 2020, which is a divisional application of U.S. patent application Ser. No. 15/097,041, filed Apr. 12, 2016, now U.S. Pat. No. 10,604,925, which claims priority pursuant to 35 U.S.C. 119(e) to U.S. Provisional Patent Application Ser. No. 62/146,347, filed Apr. 12, 2015, the entire disclosures of which are incorporated herein by reference.

FIELD OF THE INVENTION

The present invention relates generally to the field of plumbing. More specifically, the present invention relates to a drain particularly well suited for use in tiled showers, tubs, basins or the like.

BACKGROUND OF THE INVENTION

Tile basins for showers, bathtubs and the like have become extremely popular. Typically, a tile basin is constructed by first placing a cement backer board over the subfloor (typically plywood) of the desired location. Next a bottom waterproofing layer is applied to the cement board. Concrete is then poured over the bottom waterproofing layer and a top waterproofing layer is applied to the concrete after it has hardened. Finally, the tile is applied above the top waterproofing layer. The cement board, the bottom waterproofing layer, and the concrete are all installed around the housing of a drain for the basin. Typically a gap of approximately 1½ inches is left between the drain housing and the edge of the second waterproofing layer. This is intended to allow moisture to seep through the concrete and into the drain through weep holes in the drain housing. Notwithstanding, in practice the weep holes around the sides of the drain housing do very little to ensure that all moisture captured within the basin actually exits through the drain. Moreover, intentionally allowing moisture to seep into the concrete can often result in leaks and other problems. Therefore, it would be beneficial to provide a tile floor drain that is completely "water tight" (e.g. allows for the top waterproofing layer to continue all the way to the edge of the drain body).

In addition, most prior art drains require that the drain height be determined before the concrete is poured. This requires the installer to determine the thickness of the tile that will be installed around the drain and set the height of the drain above the top of the concrete surface an amount approximately equal to the thickness of the tile. Once the concrete is poured, the height of the drain can no longer be adjusted. For example, with respect to common circular drains used in tile basins, the threads of the drain are surrounded by the concrete. Thus, if the homeowner decides to use a different thickness of tile, the drain must be broken out of the concrete, and costly repairs to the area are often required. Therefore, it would be beneficial to provide a tile floor drain that is capable of being adjustable in height even after concrete has been poured and hardened around the drain body.

Finally, linear drains are often desirable for larger tile basins. The linear drains are typically designed to extend from wall to wall within the basin. As such, linear drains are typically custom-ordered and manufactured to the specific length required for a particular basin, often requiring 4 to 6 weeks of lead time. This results in linear drains being extremely time consuming to install (often requiring 4 to 6 weeks wait until custom drain is manufactured), as well as very expensive. Some adjustable length linear drains have been developed, but such drains require the installer to piece together multiple "links" until the desired length of drain is obtained. This is extremely time consuming and cumbersome for the installer. In addition, the complexity and multiple components of such drains create ample opportunity for improper installation and leakage. Therefore, it would be beneficial to provide a linear tile floor drain that is capable of easier installation in basins of varying dimensions.

SUMMARY OF THE INVENTION

Various embodiments of the instant invention provide a tile floor drain that is completely or generally (according to manufacturer specifications for waterproofing material) "water tight" (e.g. allows for the waterproofing layer at the top of the concrete to continue all the way to the edge of the drain body), a drain that is capable of being adjustable in height even after concrete has been poured and hardened around the drain body, and/or in linear embodiments, a drain that is capable of relatively easy installation in basins of varying dimensions.

Preferred embodiments of the inventive tile drain comprise a drain body that includes three different access points for water: the main drain itself; top weep holes; and sub weep holes. Preferred embodiments of the drain body further include a bottom lip that extends around at least a portion of the drain body. In preferred embodiments, the lip extends around any portion of the drain body to which floor tile is intended to abut. Preferred embodiments of the drain also include a drain cover that is adjustable in height with respect to the drain body after the drain body has been installed.

In some embodiments in which the bottom lip is included, the lip thickness is approximately ½ inch. In such embodiments, ½ inch thick cement board can be installed as a sub-pour around and up to the bottom lip such that the cement board is generally flush with the top of the bottom lip. Then a bottom waterproofing layer is applied over the cement board and at least of portion of the lip to create a watertight layer across the entire sub-pour that continues all the way into the drain body. In some embodiments, the waterproofing layer is formed by applying one or more coats of a roll-on waterproofing membrane. The sub weep holes extend from the lip into the interior of the drain body into the main drain. This allows any moisture that might accumulate on top of the bottom waterproofing layer to be directed into the main drain through the sub weep holes.

Concrete is poured over the bottom waterproofing layer (after the waterproofing has dried) around the drain body. In some embodiments, the height of the drain body that extends above the bottom lip is approximately 1½ inches. This allows for the installer to pour concrete to be flush with the top of the drain body while maintaining a 1½ inch concrete pour height, as is standard in the industry pursuant to TCNA recommendations. Once the concrete has sufficiently hardened, a second waterproofing layer is applied over the top of the concrete and at least a portion of the top of the drain body to create a watertight layer across the entire concrete floor that continues all the way into the drain body. Top weep holes are included in the top of the drain body to allow moisture that might accumulate on top of the second waterproofing layer to be directed into the main drain through the top weep holes.

Once the second waterproofing layer is applied (and properly dried, according to manufacturer recommendations), tile is installed over the top of the drain body up to the main drain opening. Finally, the adjustable height drain cap is installed in the main drain opening to complete the installation.

In some embodiments, the bottom lip and/or the weep holes are sloped downward from the outer edge of the lip toward the interior of the main drain, urging moisture into the main drain.

In some embodiments, the drain body is generally round in shape. In some such embodiments, the drain cap is installed into the drain body via a threaded relationship. The threaded connection allows for the height of the drain cap to be adjusted up and down.

In some embodiments, the drain body is generally linear in shape. In some such embodiments, shims are included to allow the height of the drain cap to be adjusted up and down. In some embodiments, the shims are glued or otherwise connected to a lip that extends along an interior wall of the main drain for supporting the drain cap. The number or thickness of shims depends upon the thickness of the tile and is chosen by the installer to place the height of the cap such that it is flush with the top of the tile.

In some embodiments of the linear drain intended to be installed generally centrally within a basin, the drain body is generally symmetrical about a longitudinal axis of the drain and includes a bottom lip, sub weep holes and top surface with top weep holes on both sides of the longitudinal axis. In such embodiments, tile is installed over the top weep holes from both sides of the drain up to both sides of the main drain opening. In other embodiments of the linear drain intended to be installed along a side wall of the basin, the drain body is asymmetrical about a longitudinal axis of the drain, including a bottom lip, sub weep holes and top surface with top weep holes on only one side of the longitudinal axis. In such embodiments, the side without the bottom lip and top surface is installed against the side wall of the basin. Tile from the side wall generally extends over the side wall of the drain body and floor tile is installed over the top surface side up to the main drain opening.

In some embodiments, the drain comes in a kit that includes all items necessary for an installer to install the drain. Specifically, in some embodiments of the linear drain, the drain body and drain cap are provided as part of a kit that includes two end caps, end-cap glue/adhesive, a roll of fiber mesh tape, a tube of silicone, drain shims, cement board shims, and compatible waterproofing caulk. During installation, the installer cuts the drain body to the desired length and glues on the end caps to seal the drain body. In embodiments of a kit for the circular drain, shims and end cap adhesive are not necessary.

In some embodiments, the drain of the instant invention is made of a PVC material or other suitable. In some such embodiments, the drain is manufactured through a blow molding process.

The foregoing and other objects are intended to be illustrative of the invention and are not meant in a limiting sense. Many possible embodiments of the invention may be made and will be readily evident upon a study of the following specification and accompanying drawings comprising a part thereof. Various features and sub-combinations of invention may be employed without reference to other features and sub-combinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION OF A PREFERRED EMBODIMENT

Figure 1:
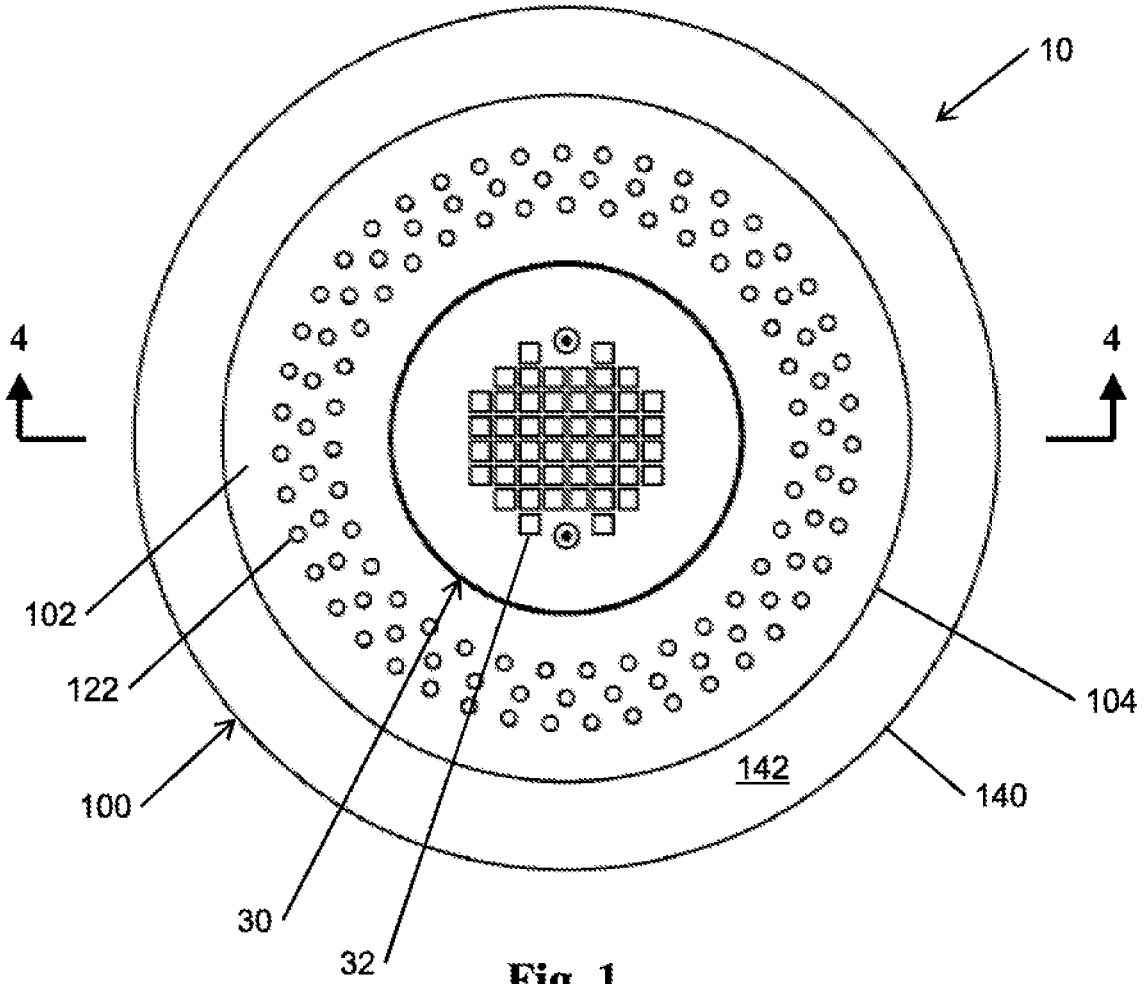
FIG. 1 is a top view of a circular tile drain of the present invention.
Figure 2:
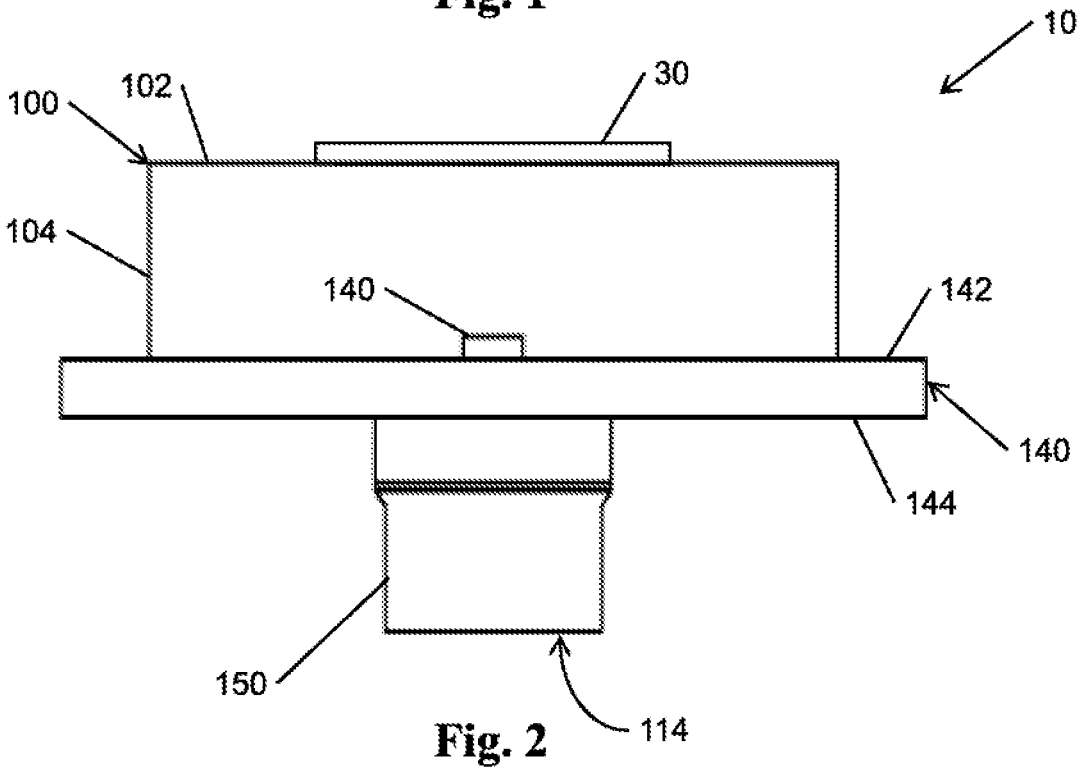
FIG. 2 is a side view of the tile drain of FIG. 1.
Figure 3:
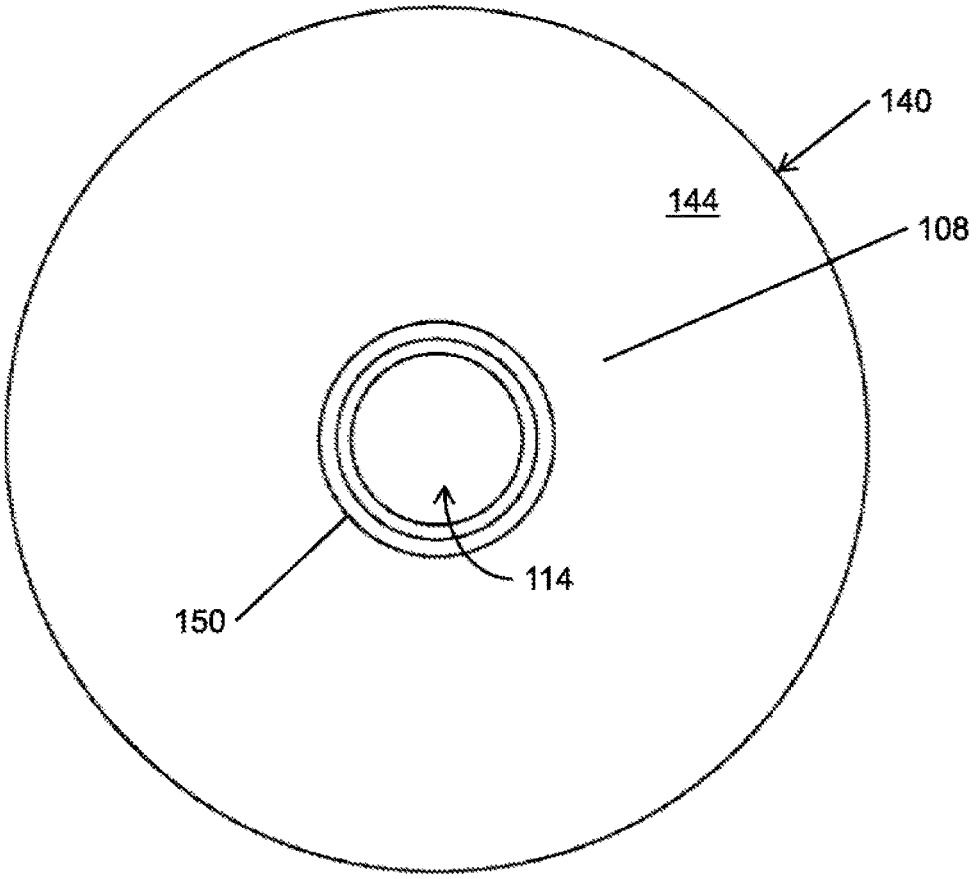
FIG. 3 is a bottom view of the tile drain of FIG. 1.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 1, 2, 6, 9A, 9C, 11A, and 11C, a preferred embodiment of the tile drain 10 of the present invention includes a drain body 100 that defines top weep apertures 122 and sub weep apertures 124, the top weep apertures 122 being vertically displaced upwards from the sub weep apertures 124. In some embodiments, the tile drain 10 is configured for use with a base 200, such as a shower base, a sink base, or some other base, so as to accommodate draining fluids from the base 200. In other embodiments, the tile drain 10 is configured for use with a base 200 that includes a plurality of layers, such as a support structure 210, a first intermediate layer 220, a bottom waterproofing layer 230, a second intermediate layer 240, a top waterproofing layer 250, and/or a tile layer 260. It will be appreciated, however, that other embodiments of the tile drain 10 are configured to be used with other bases and/or in other applications other than with a base 200.

In preferred embodiments, the tile drain 10 is configured for use with a base 200 that includes vertically displaced top 250 and bottom 230 waterproofing layers and a tile layer 260 that is positioned above the top waterproofing layer 250. More specifically, top weep apertures 122 of such embodiments are configured so as to allow fluid, such as water, positioned between the tile layer 260 and the top waterproofing layer 250 to flow into the drain body 100 through the top weep apertures 122. Furthermore, sub weep apertures 124 of such embodiments are configured so as to allow fluid, such as water, positioned between the top 250 and bottom 230 waterproofing layers to flow into the drain body 100 through the sub weep apertures 124.

In preferred embodiments, the drain body 100 defines an interior area 110 in fluid communication with opposed top 112 and bottom 114 openings so as to define a fluid pathway between the top 112 and bottom 114 openings. In this way, fluid flowing into the drain body 100 through the top opening 112 is directed out of the drain body 100 through the bottom opening 114. In some embodiments, the drain body is configured so as to accommodate draining fluid from a preliminary area, such as above a tile layer 260, by allowing incoming fluid from the preliminary area to flow into the interior area 110 through the top opening 112 and outgoing fluid to flow out of the interior area 110 through the bottom opening 114.

In another preferred embodiment, the drain body defines one or more weep chamber 120 in fluid communication with the weep apertures 122, 124 and the bottom opening 114 so as to define a fluid pathway between the weep apertures 122, 124 and the bottom opening 114. In this way, fluid flowing into the drain body 100 through the weep apertures 122, 124 is directed out of the drain body 100 through the bottom opening 114. In some embodiments, the drain body 100 includes one or more inner wall 106 separating the one or more weep chambers 120 from an interior area 110 of the drain body 100 so as to prevent or otherwise inhibit fluid in the interior area 110 of the drain body 100 from flowing out of the a drain body 100 through the weep apertures 122, 124.

In preferred embodiments, the bottom opening 114 of the drain body 100 is defined by a bottom portion 150 of the drain body 100. In some such embodiments the bottom portion 150 of the drain body 100 is configured to selectively couple to a pipe (not shown), such as a sewer pipe, so as to direct the outgoing fluid away from the tile drain 10 through the pipe.

In a preferred embodiment, the tile drain 10 is a circular tile drain 10. In some embodiments of a circular tile drain 10, the drain body 100 includes a continuous outer wall 104, a concentric continuous inner wall 106, and a top wall 102 extending between the inner 106 and outer 104 walls. In this way, the drain body 100 defines a cylindrical interior area 110 that is positioned within the inner wall 106, a circular top opening 112 that is positioned at an upper end of the interior area 110, and a continuous weep chamber 120 that is positioned between the inner 106 and outer 104 walls. In some such embodiments, the drain body 100 also includes a bottom wall 108 extending from the outer wall 104 towards the inner wall 106 so as to define a bottom opening 114 that is positioned at a lower end of the interior area 110. In other such embodiments, a bottom portion 150 extends downward from a bottom wall 108 of the drain body 100 so as to define a bottom opening 114 that is displaced downward from the bottom wall 108.

In another preferred embodiment, the tile drain 10 is a symmetric linear tile drain 10. In some embodiments of a symmetric linear tile drain 10, the drain body 100 includes at least one longitudinal portion 190 extending between a distal end 192 of the longitudinal portion 190 and a bottom opening 114 of the drain body 100. In other embodiments, the drain body 100 includes opposed first and second outer walls 104, opposed first and second inner walls 106 positioned between the first and second outer walls 104, opposed first and second top walls extending between respective inner 106 and outer 104 walls, and a bottom wall 108 extending between the first and second outer walls 104. In this way, the drain body 100 defines an elongated interior area 110 that is positioned between the first and second inner walls 106, a rectangular top opening 112 that is positioned at an upper end of the interior area 110, and first and second elongated weep chambers 120 that is positioned between respective inner 106 and outer 104 walls. In some such embodiments, the bottom wall 108 defines a bottom opening 114 that is positioned at a lower end of the interior area 110. In other such embodiments, a bottom portion 150 extends downward from the bottom wall 108 so as to define a bottom opening 114 that is displaced downward from the bottom wall 108.

In yet another preferred embodiment, the tile drain 10 is an asymmetric linear tile drain 10. In some embodiments of an asymmetric linear tile drain 10, the drain body 100 includes at least one longitudinal portion 190 extending between a distal end 192 of the longitudinal portion 190 and a bottom opening 114 of the drain body 100. In other embodiments, the drain body 100 includes an outer wall 104, an opposed longitudinal wall 194, an inner wall 106 positioned between the outer wall 104 and the longitudinal wall 194, a top wall 102 extending between the inner 106 and outer 104 walls, and a bottom wall 108 extending between the outer wall 104 and the longitudinal wall 194. In this way, the drain body 100 defines an elongated interior area 110 that is positioned between the inner wall 106 and the longitudinal wall 194, a rectangular top opening 112 that is positioned at an upper end of the interior area 110, and an elongated weep chambers 120 that is positioned between the inner 106 and outer 104 walls. In some such embodiments, the bottom wall 108 defines a bottom opening 114 that is positioned at a lower end of the interior area 110. In other such embodiments, a bottom portion 150 extends downward from the bottom wall 108 so as to define a bottom opening 114 that is displaced downward from the bottom wall 108.

In some embodiments of the present invention, the tile drain 10 includes one or more end cap 20. In some embodiments, each of the one or more end caps 20 is configured to selectively couple to a respective distal end 192 of a longitudinal portion 190 of the drain body 100. In some such embodiments, the end cap 20 is configured to selectively couple to the distal end 192 of the drain body 100, such as with a snapping mechanism, a compression mechanism, a sliding mechanism, and/or some other mechanical means now known or later developed. In other such embodiments, the end cap 20 is bonded to the distal end 192 of the drain body 100, such as with silicone or some other bonding agent now known or later developed. In still other such embodiments, the end cap 20 is sealed to the drain body 100 so as to prevent fluid from escaping the drain body 100 through the distal end 192 of the drain body 100.

In some embodiments, the drain body 100 of the instant invention is fabricated at least partially from a polyvinyl chloride material or other suitable material so as to accommodate cutting the drain body 100 prior to installation of the drain body 100. In this way, a portion of the longitudinal portion 190 of the drain body 100 can be removed, thereby simultaneously changing the length of the drain body 100 and the position of the distal end 192 of the longitudinal portion 190 of the drain body 100.

Referring to FIGS. 5, 6, 10C, 12C, 17E, 17F, 17G, and 18 some embodiments of the present invention include a top wall 102 of the drain body 100 that defines a top opening 112 and a plurality of top weep apertures 122. In some such embodiments, the top wall 102 is configured so as to be capable of interfacing with a top waterproofing layer 250 (FIG. 17E) such that fluid positioned above the top waterproofing layer 250 can be directed into the drain body 100 through the top weep apertures 122. In other such embodiments, the top wall 102 is configured so as to be capable of interfacing with a tile layer 260 (FIG. 17F) such that fluid positioned above the tile layer 260 can be directed into the drain body 100 through the top opening 112.

In some embodiments an outer wall 104 of the drain body 100 defines a plurality of sub weep apertures 124. In some such embodiments, the outer wall 104 is configured so as to be capable of interfacing with a bottom waterproofing layer 230 that is downwardly displaced from the top waterproofing layer 250 such that fluid positioned between the top 250 and bottom 230 waterproofing layers can be directed into the drain body 100 through the sub weep apertures 124.

Referring to FIGS. 6, 10C, 12C, 17C, 17G, and 18, some embodiments of the present invention include a bottom lip 140 that extends outward from the outer wall 104 of the drain body 100. In some such embodiments, the bottom lip 140 is an extension of the bottom wall 108 of the drain body 100. In other such embodiments, the bottom lip 140 is independent of the bottom wall 108 of the drain body 100.

Figure 7:
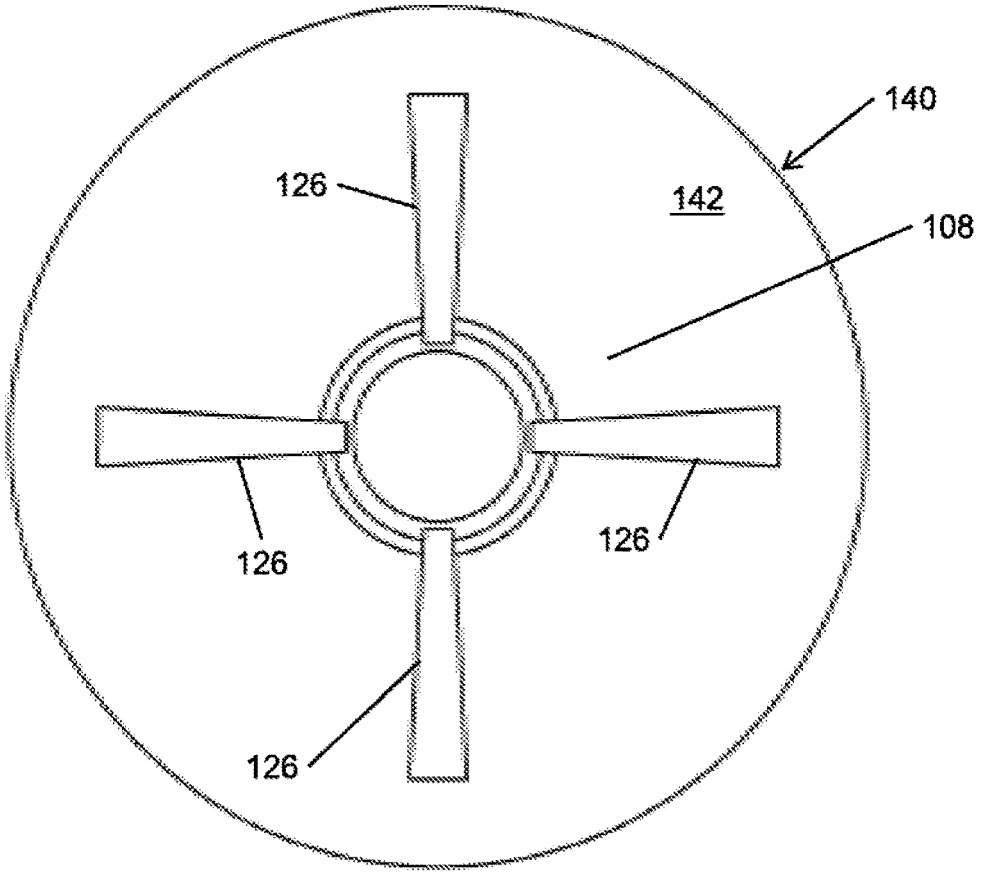
FIG. 7 is a top view of a portion of the drain body of FIG. 5.
Figure 8:
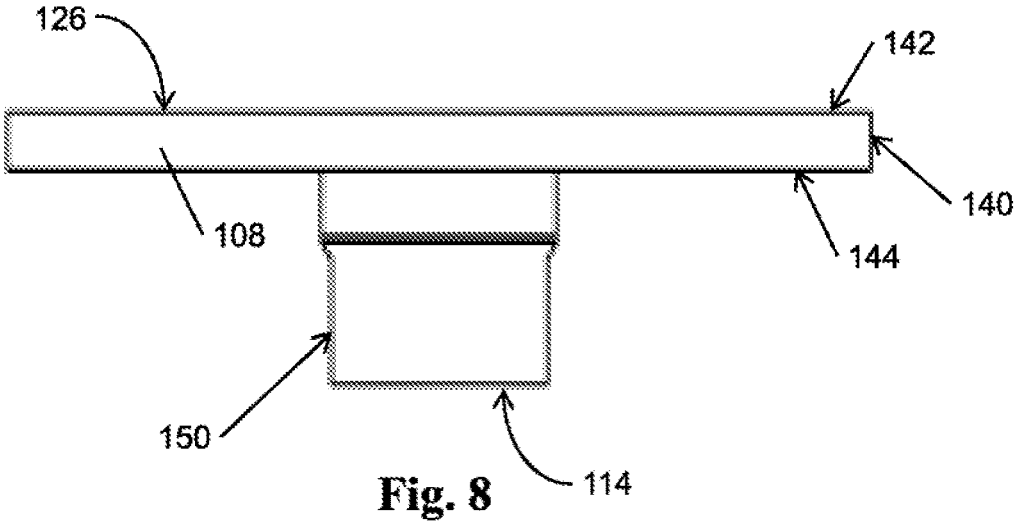
FIG. 8 is a side view of a portion of the drain body of FIG. 5.
Figure 9A:
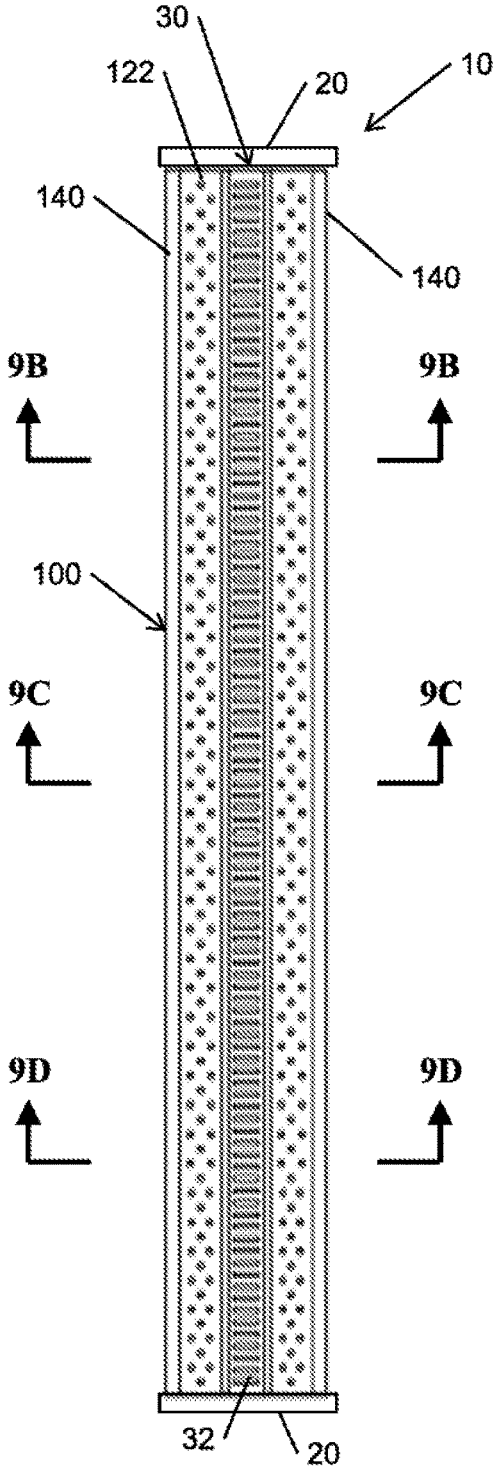
FIG. 9A is a top view of a symmetrical longitudinal tile drain of the present invention.
Figure 9B:
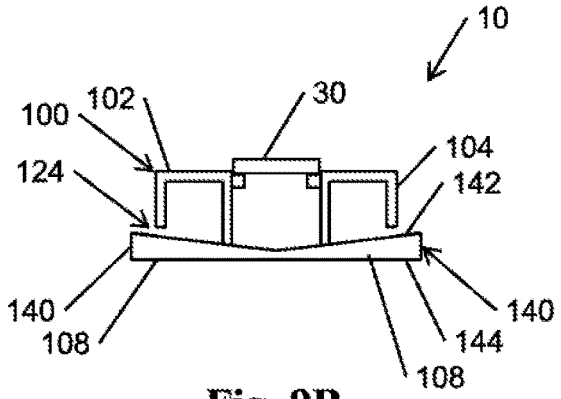
FIG. 9B is a sectional view taken along line 9B-9B of FIG. 9A.
Figure 9C:
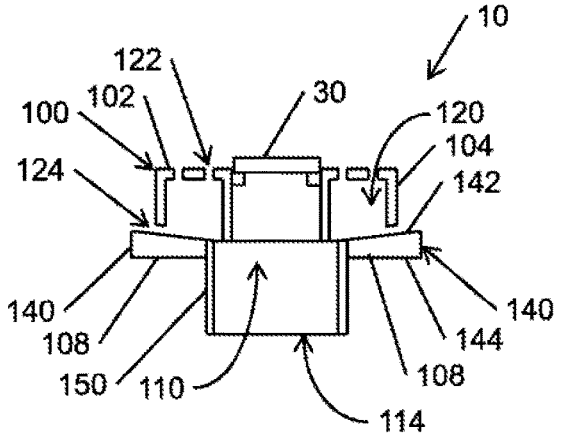
FIG. 9C is a sectional view taken along line 9C-9C of FIG. 9A.
Figure 9D:
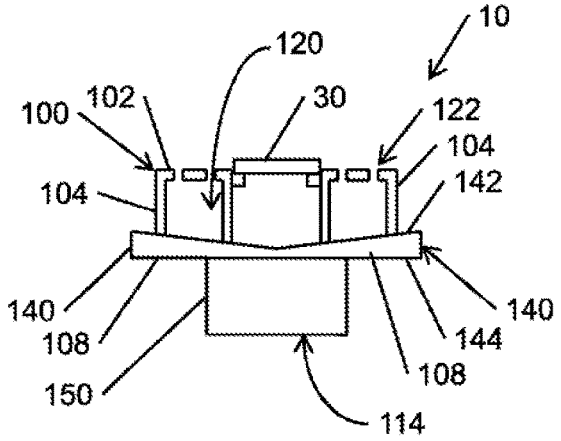
FIG. 9D is a sectional view taken along line 9D-9D of FIG. 9A.
Figure 10A:
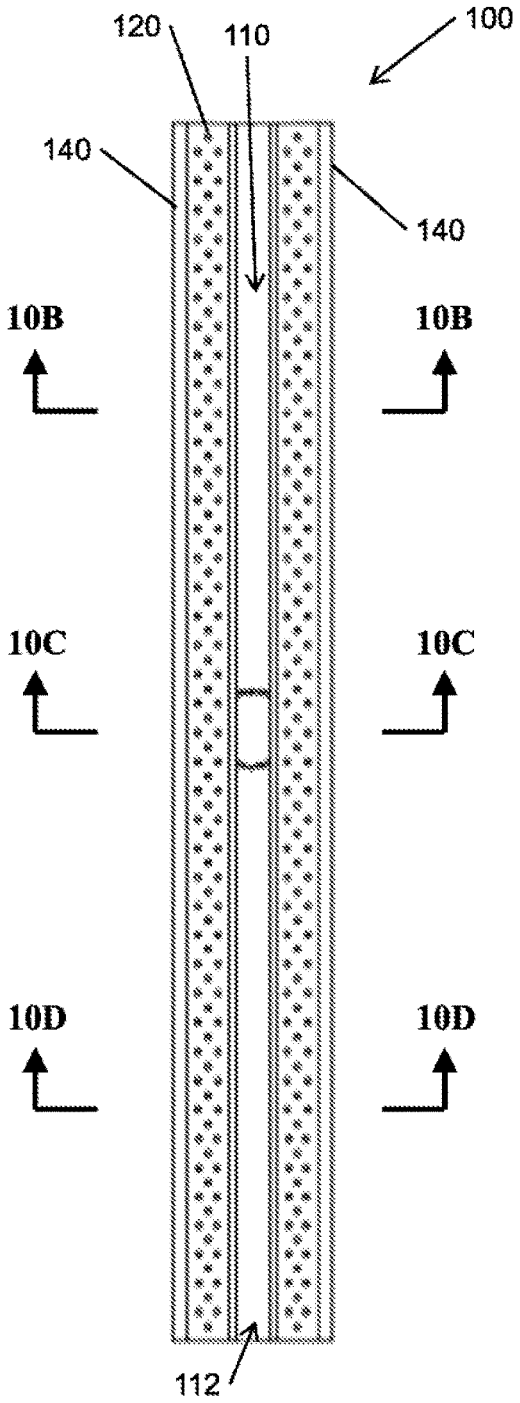
FIG. 10A is a top view of a drain body of a symmetrical longitudinal tile drain of the present invention.
Figure 10B:
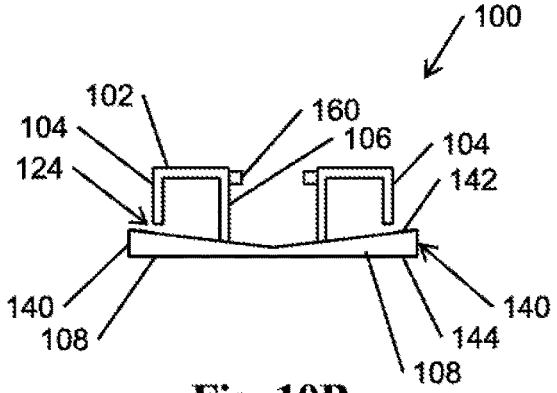
FIG. 10B is a sectional view taken along line 10B-10B of FIG. 10A.
Figure 10C:
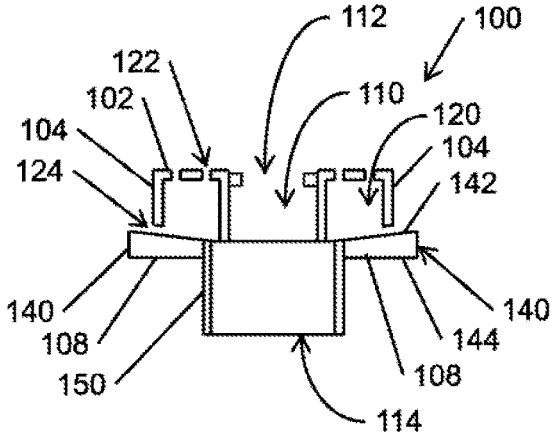
FIG. 10C is a sectional view taken along line 10C-10C of FIG. 10A.
Figure 10D:
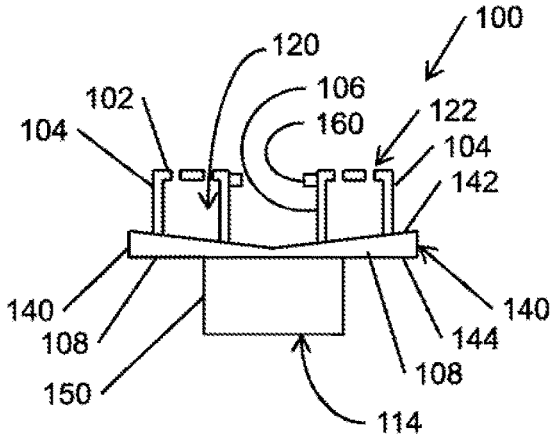
FIG. 10D is a sectional view taken along line 10D-10D of FIG. 10A.
Figure 11A:
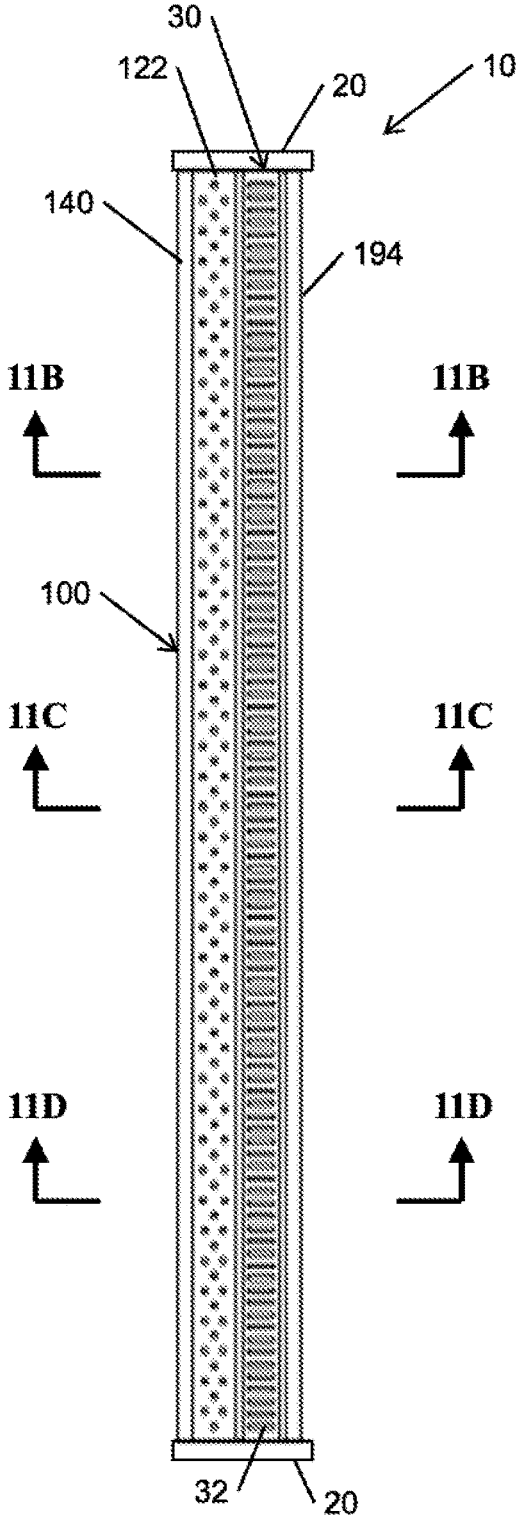
FIG. 11A is a top view of an asymmetrical longitudinal tile drain of the present invention.
Figure 11B:
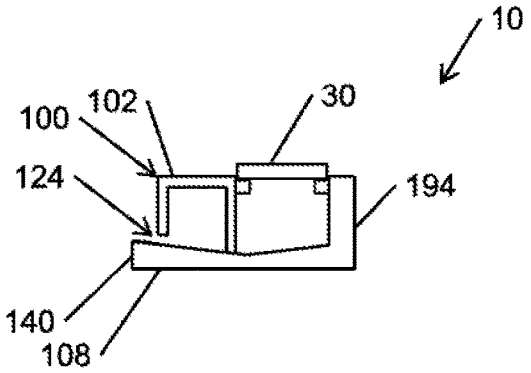
FIG. 11B is a sectional view taken along line 11B-11B of FIG. 11A.
Figure 11C:
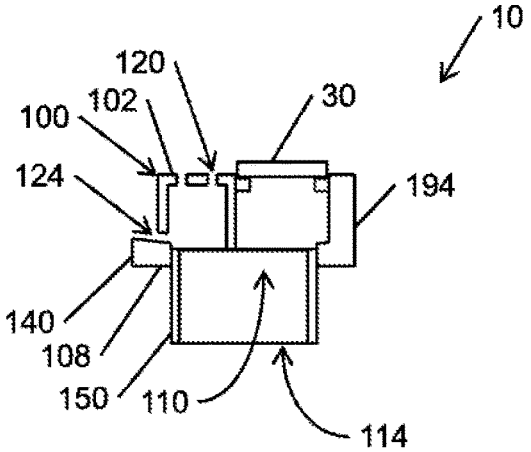
FIG. 11C is a sectional view taken along line 11C-11C of FIG. 11A.
Figure 11D:
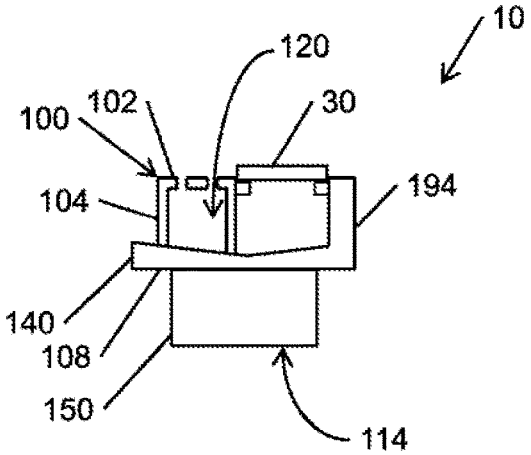
FIG. 11D is a sectional view taken along line 11D-11D of FIG. 11A.
Figure 12A:
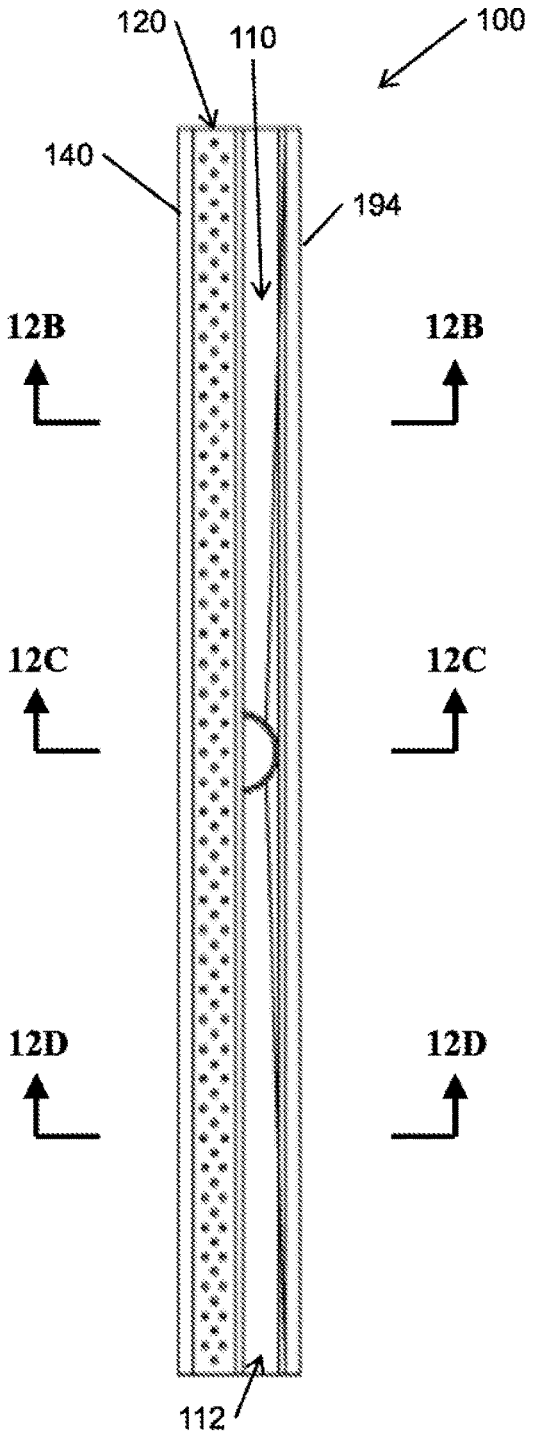
FIG. 12A is a top view of a drain body of an asymmetrical longitudinal tile drain of the present invention.
Figure 12B:
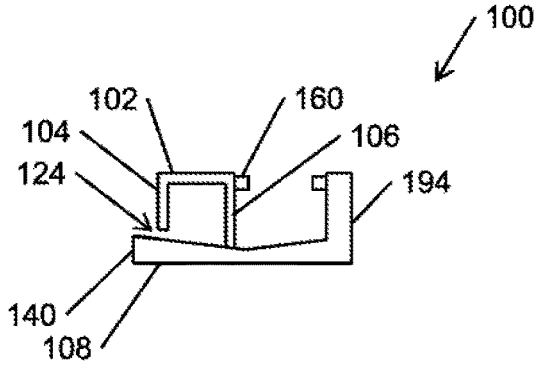
FIG. 12B is a sectional view taken along line 12B-12B of FIG. 12A.
Figure 12C:
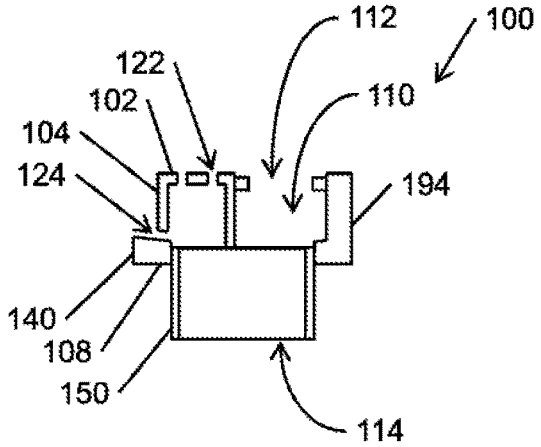
FIG. 12C is a sectional view taken along line 12C-12C of FIG. 12A.
Figure 12D:
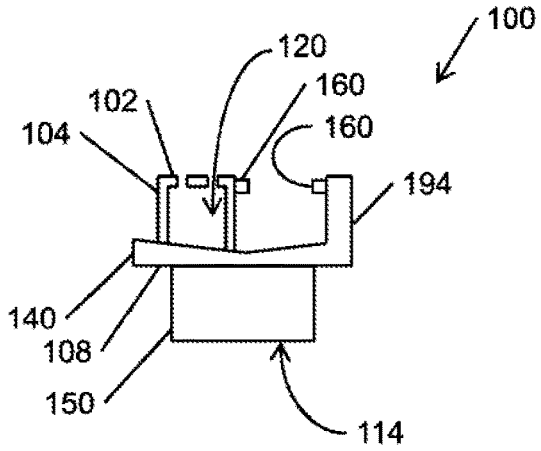
FIG. 12D is a sectional view taken along line 12D-12D of FIG. 12A.
Figure 13:
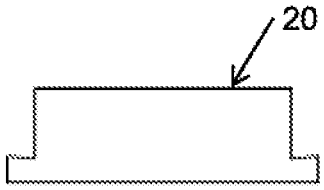
FIG. 13 is an end view of an end cap of a symmetrical tile drain of the present invention.
Figure 14:
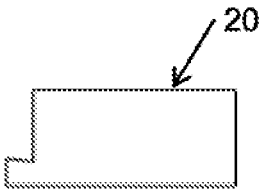
FIG. 14 is an end view of an end cap of an asymmetrical tile drain of the present invention.
Figure 15A:
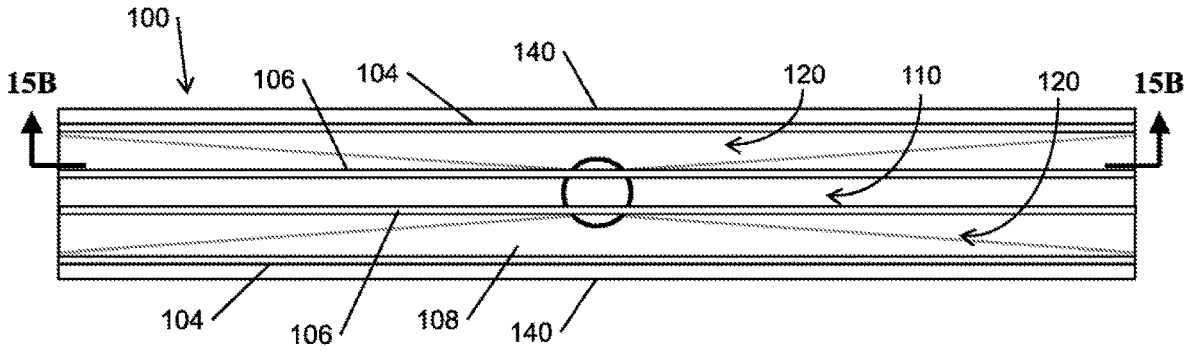
FIG. 15A is a top view of a drain body of a symmetrical longitudinal tile drain of the present invention with the top walls of the drain body removed for clarity.
Figure 15B:
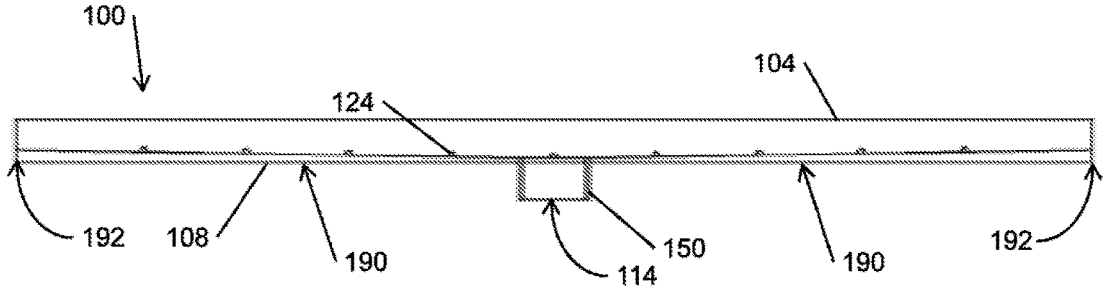
FIG. 15B is a sectional view taken along line 15B-15B of FIG. 15A.
Figure 16A:
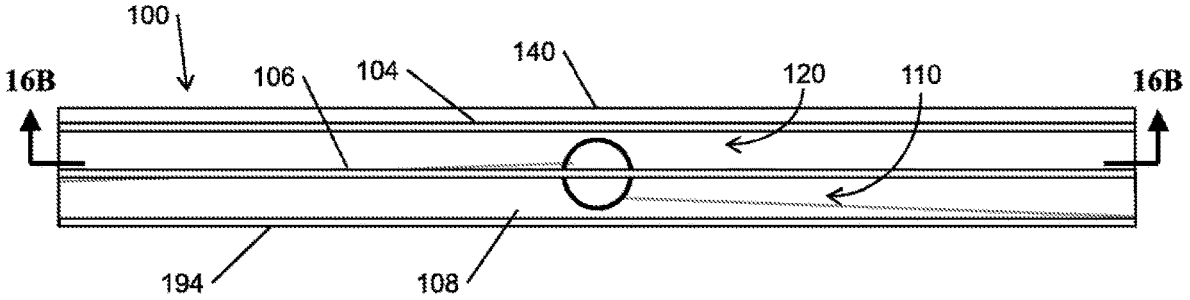
FIG. 16A is a top view of a drain body of an asymmetrical longitudinal tile drain of the present invention with the top walls of the drain body removed for clarity.
Figure 16B:
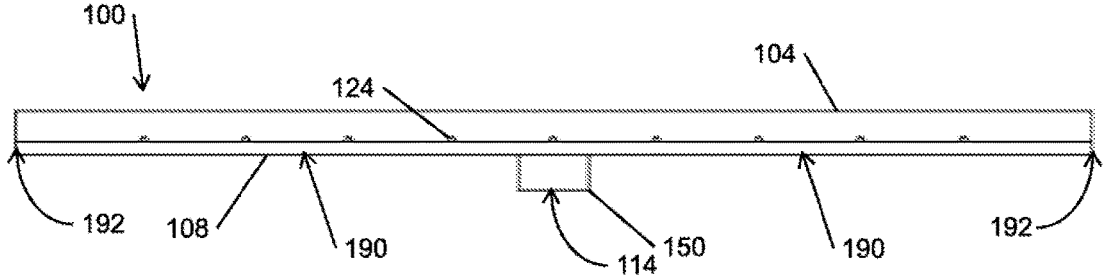
FIG. 16B is a sectional view taken along line 16B-16B of FIG. 16A.
Figure 17A:
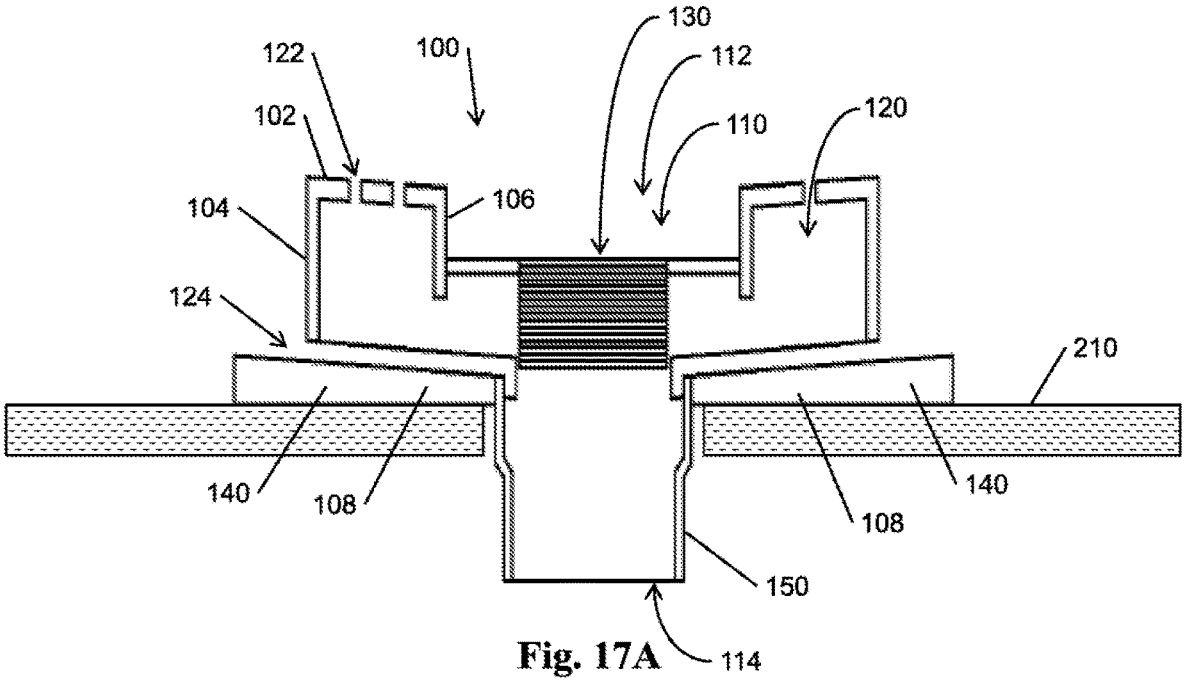
FIG. 17A is a sectional view of a drain body of a circular tile drain of the present invention, the drain body being supported by a support structure.
Figure 17B:
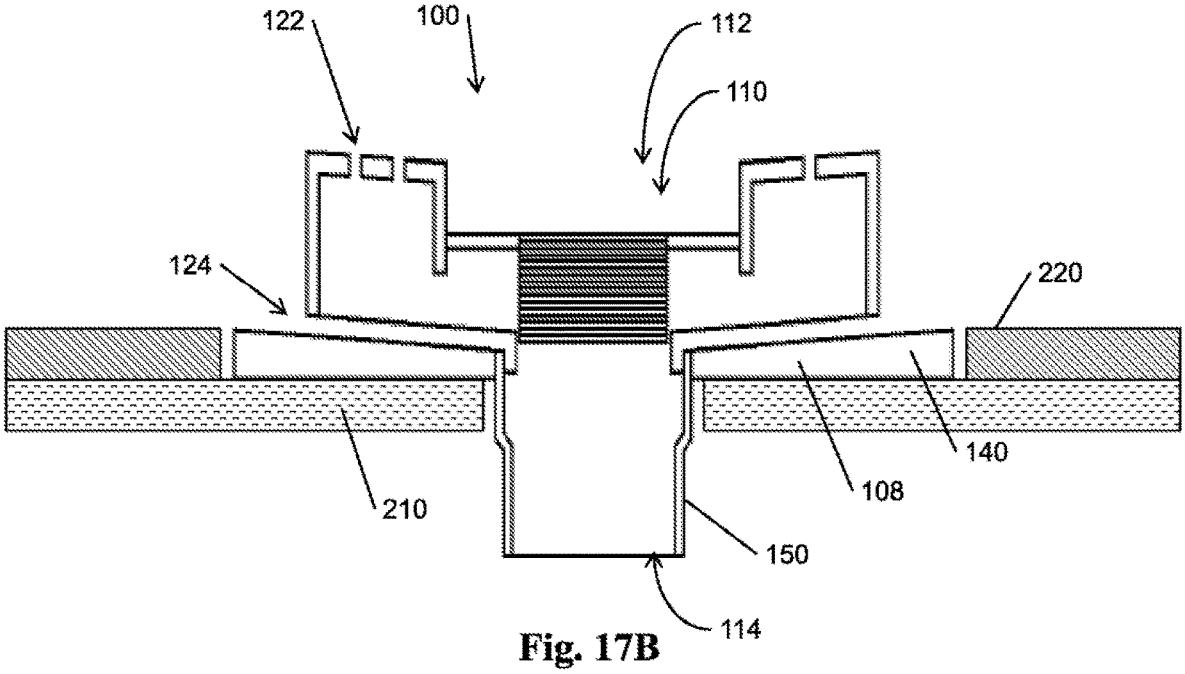
FIG. 17B is the sectional view of FIG. 17A with a first intermediate layer installed onto the support structure, the first intermediate layer being positioned around a bottom lip of the drain body.
Figure 17C:
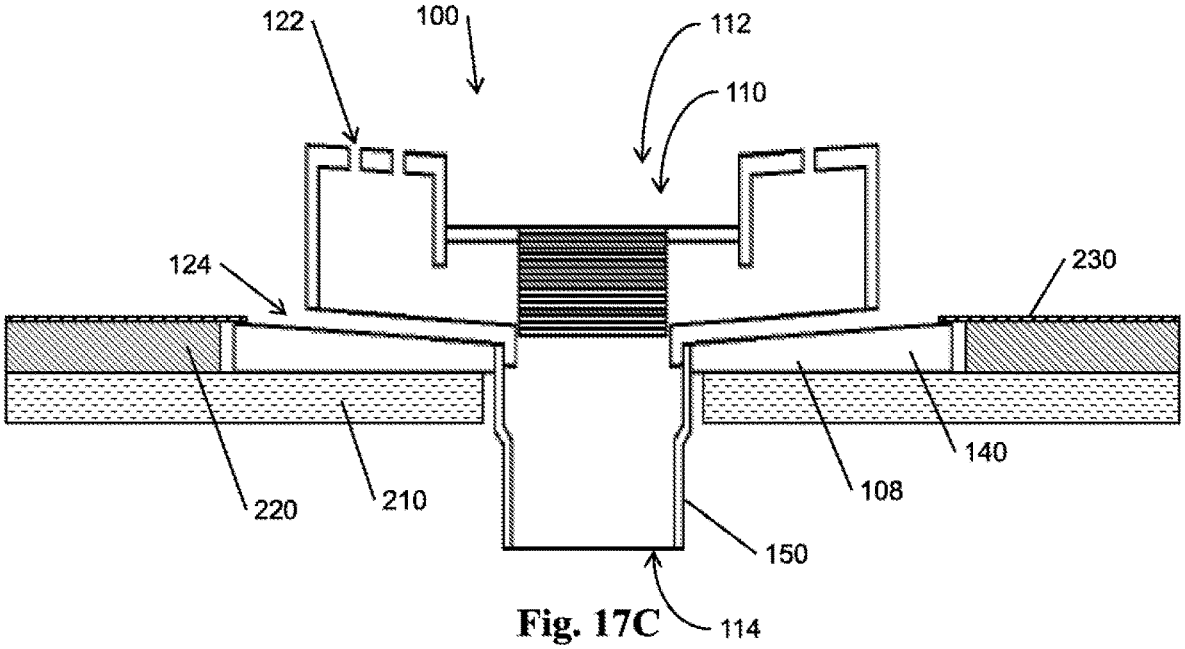
FIG. 17C is the sectional view of FIG. 17B with a bottom waterproofing layer installed onto the first intermediate layer and extending onto a top surface of the bottom lip of the drain body.
Figure 17D:
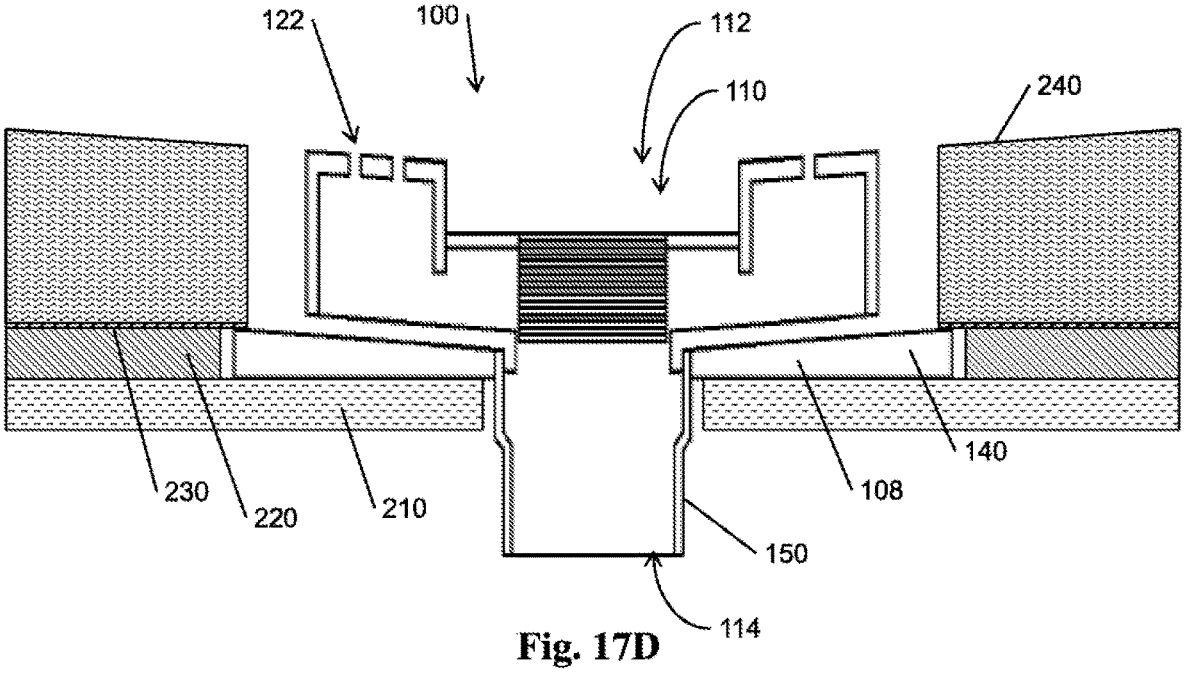
FIG. 17D is the sectional view of FIG. 17C with a second intermediate layer installed onto the bottom waterproofing layer, the second intermediate layer being positioned around an outer wall of the drain body.
Figure 17E:
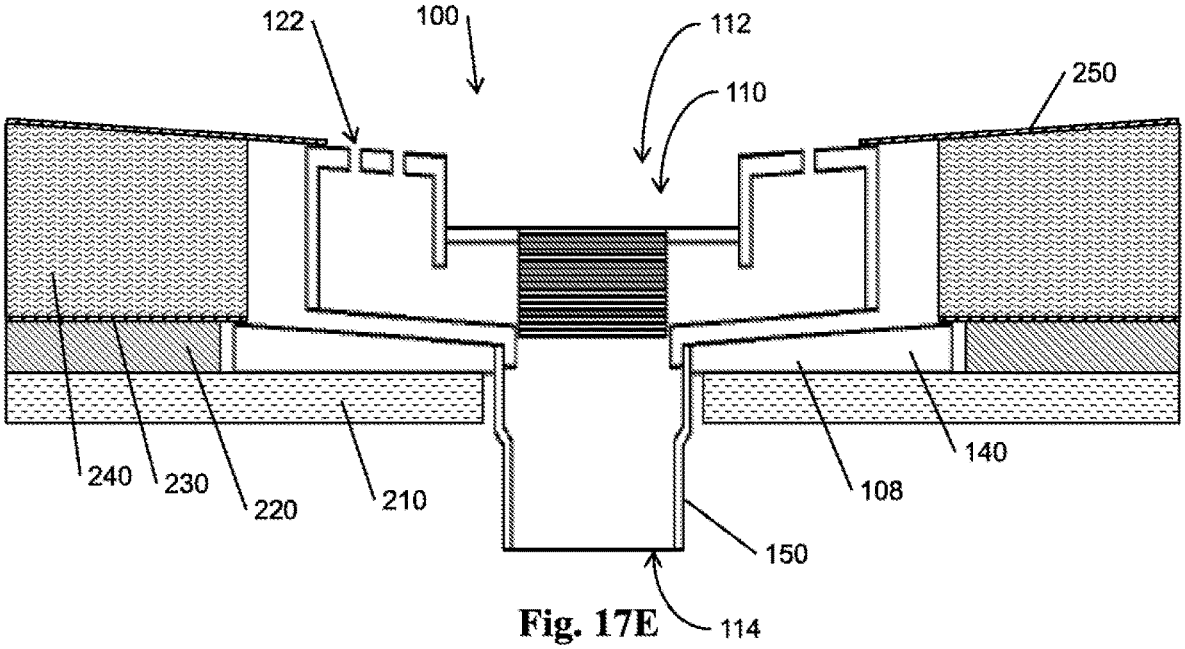
FIG. 17E is the sectional view of FIG. 17D with a top waterproofing layer installed onto the second intermediate layer and extending onto a top surface of a top wall of the drain body.
Figure 17F:
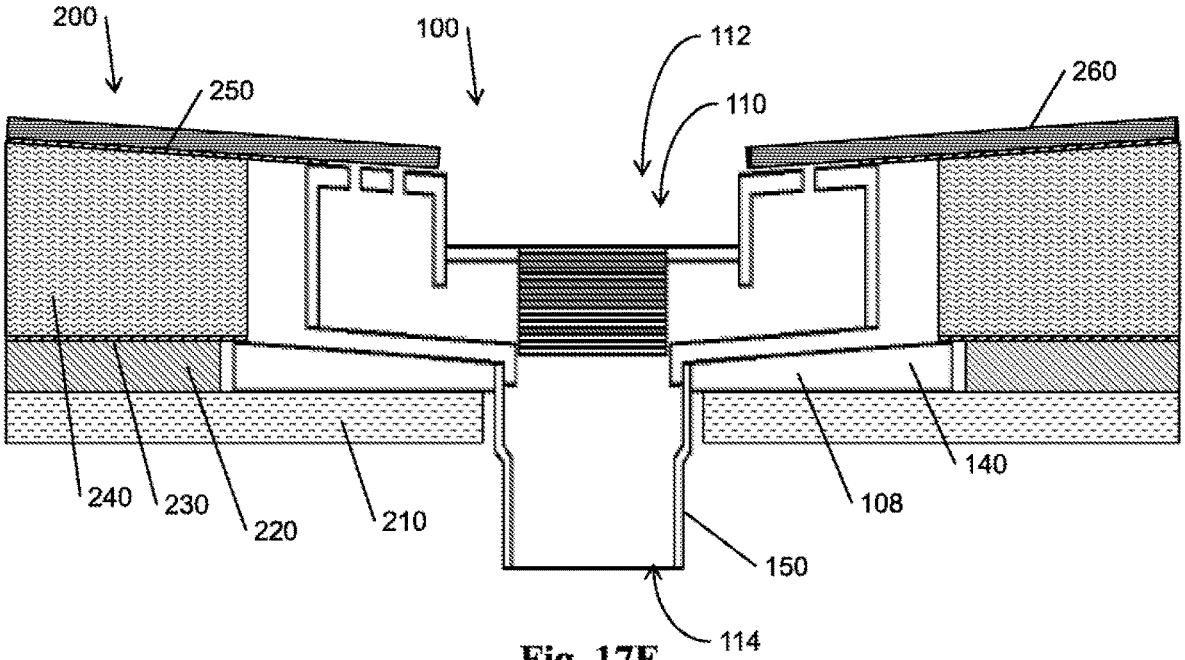
FIG. 17F is the sectional view of FIG. 17E with a tile layer installed onto the top waterproofing layer and extending to a top opening of the drain body, thereby encapsulating the drain body within a base.
Figure 17G:
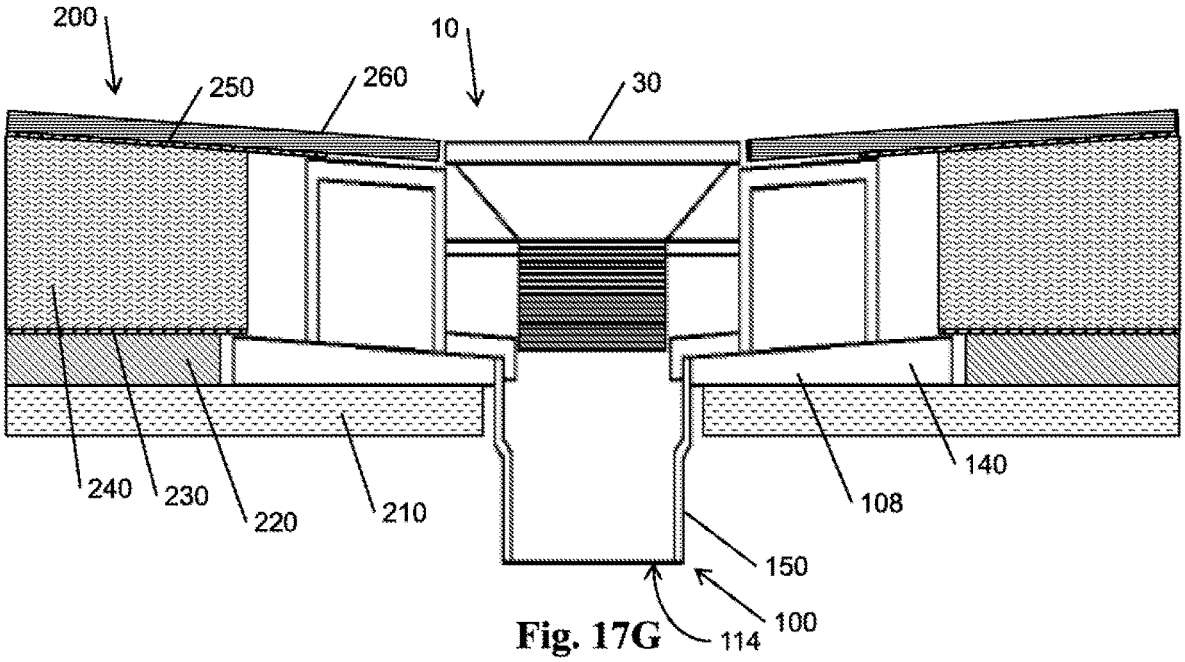
FIG. 17G is the sectional view of FIG. 17F with a drain cover extending into the drain body through the top opening of the drain body.
Figure 18:
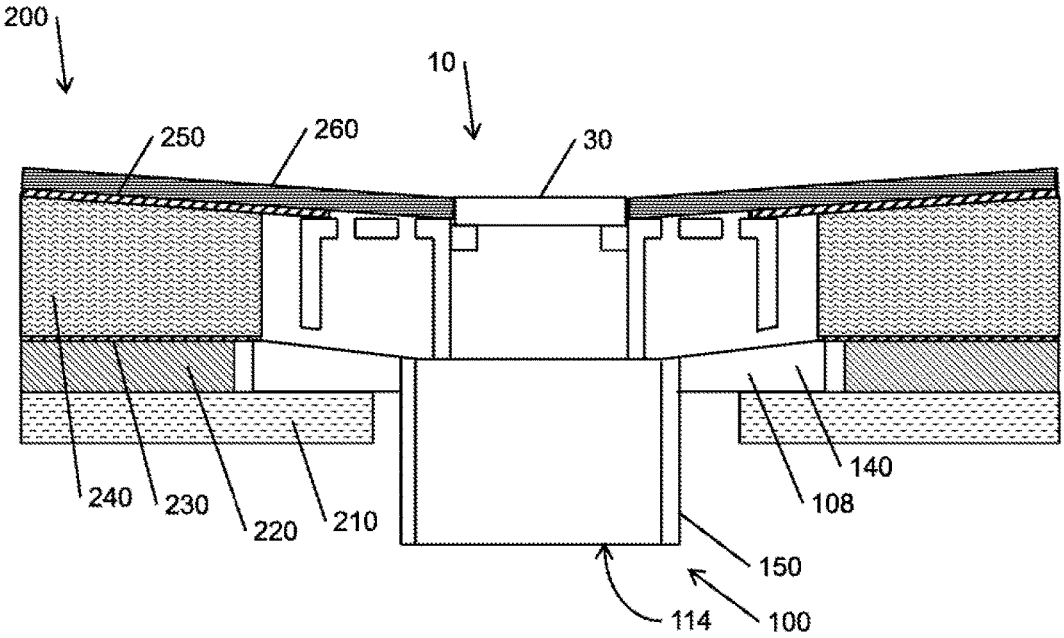
FIG. 18 is a sectional view of a symmetrical longitudinal tile drain of the present invention encapsulated within a base.
Figure 19:
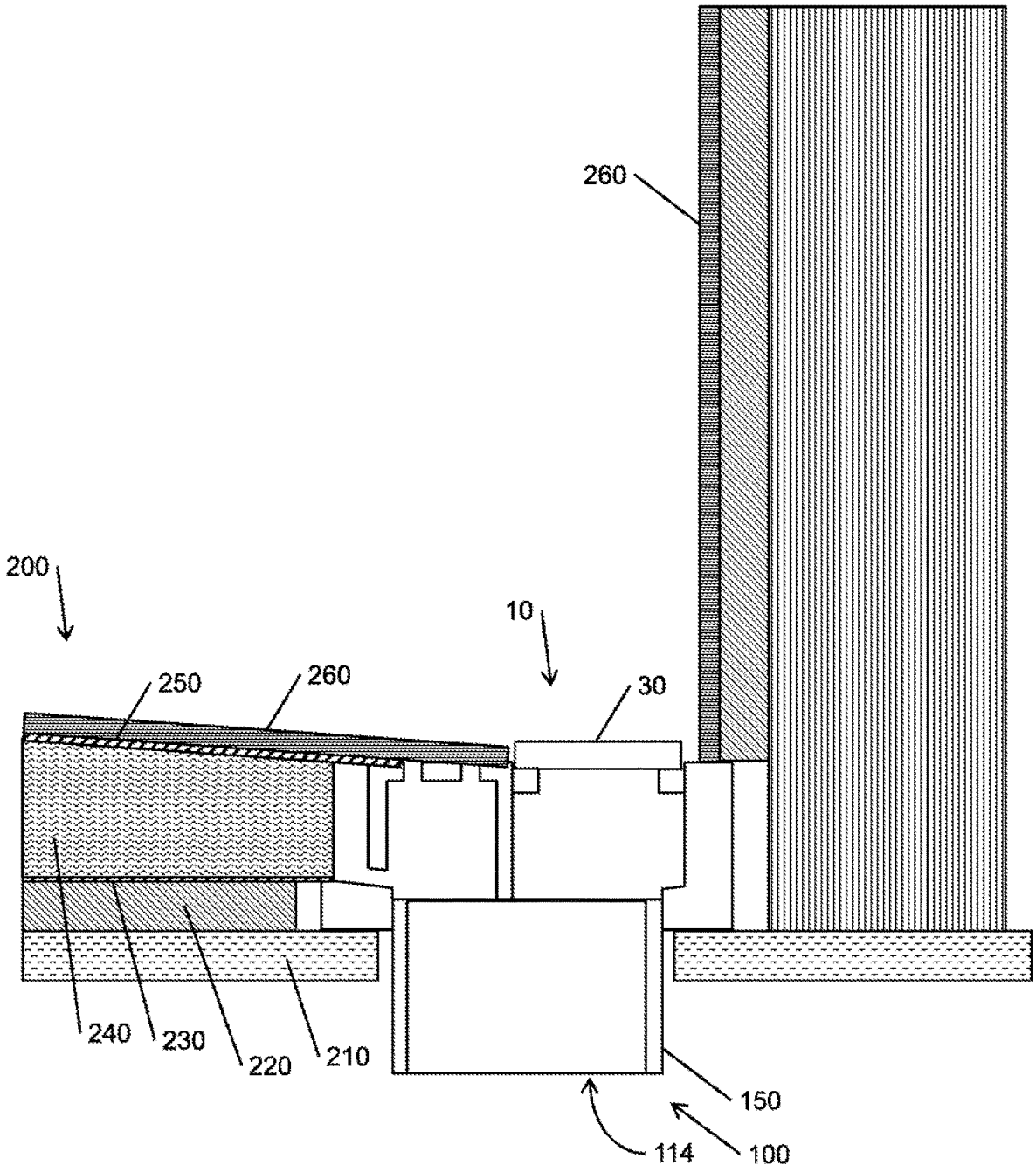
FIG. 19 is a sectional view of an asymmetrical longitudinal tile drain of the present invention encapsulated within a base.

In some embodiments, sub weep apertures 124 formed in the outer wall 104 are positioned directly above the bottom lip 140. In preferred embodiments, the bottom lip 140 is configured so as to be capable of interfacing with the bottom waterproofing layer 230 such that fluid positioned between the top 250 and bottom 230 waterproofing layers can be directed towards the bottom lip 140 and into the drain body 100 through the sub weep apertures 124. In some such embodiments, such as shown in FIG. 7, one or more sub weep raceway 126 is formed at least partially in the bottom lip 140 and/or the bottom wall 108 so as to provide a pathway for fluid flowing into the drain body 100 through the sub weep apertures 124 to flow towards the bottom opening 114 of the drain body 100. In some such embodiments, one or more sub weep raceway 126 extends under one or more outer wall 104 of the drain body 100 so as to form one or more sub weep aperture 124.

In preferred embodiments, the bottom lip 140 defines at least part of a top surface 142 that is configured to interface with the bottom waterproofing layer 230. In some embodiments, the top surface 142 extends to the outer wall 104 of the drain body 100. In other embodiments, the top surface 142 extends beyond the outer wall 104 so as to form a top surface 142 of at least a portion of the bottom wall 108 of the drain body 100. In still other embodiments, the top surface 142 extends beyond the inner wall 106 of the drain body 100 so as to help direct fluid in the drain body 100 towards the bottom opening 114 of the drain body 100.

In preferred embodiments, the bottom lip 140 defines at least part of a bottom surface 144 that is configured to interface with a support structure 210 so as to provide vertical support for the tile drain 10. In some embodiments, the bottom surface 144 extends to the outer wall 104 of the drain body 100. In other embodiments, the bottom surface 144 extends beyond the outer wall 104 so as to form a bottom surface 144 of at least a portion or the bottom wall 108 of the drain body 100. In still other embodiments, the bottom surface 144 extends beyond the inner wall 106 of the drain body 100 so as to define a bottom opening 114 of the drain body 100 and/or so as to interface with a bottom portion 150 of the drain body 100.

In some embodiments, the top surface 142 is vertically displaced upwards from the bottom surface 144. In some such embodiments, the top 142 and bottom 144 surfaces are parallel with each other. In other such embodiments, at least part of the top surface 142 is sloped downward and inward so as to direct fluid positioned outside of the drain body 100 towards the sub weep apertures 124 and/or so as to direct fluid positioned inside of the drain body 100 towards the bottom opening 114 of the drain body 100. In still other embodiments, the bottom surface 144 is relatively flat and horizontal so as to rest evenly on a flat and horizontal support structure 210. In yet other embodiments, the thickness of the bottom lip 140 corresponds with a standard thickness of standard building materials, such as cement board.

In preferred embodiments, the tile drain 10 includes one or more drain cover 30 that is configured to selectively interface with the top opening 112 of the drain body 100. In some such embodiments, the drain cover 30 defines a plurality of drain apertures 32. In other such embodiments, the drain cover 30 and the drain body 100 are configured such that the drain cover 30 is adjustable relative to the drain body 100 when the drain body 100 is fixed in position relative to a base 200 or other structure. In still other such embodiments, the drain cover 30 and the drain body 100 are configured such that the drain cover 30 is removable from the drain body 100 without requiring any portion of the base 200 and/or the drain body 100 to be moved and/or removed.

Figure 4:
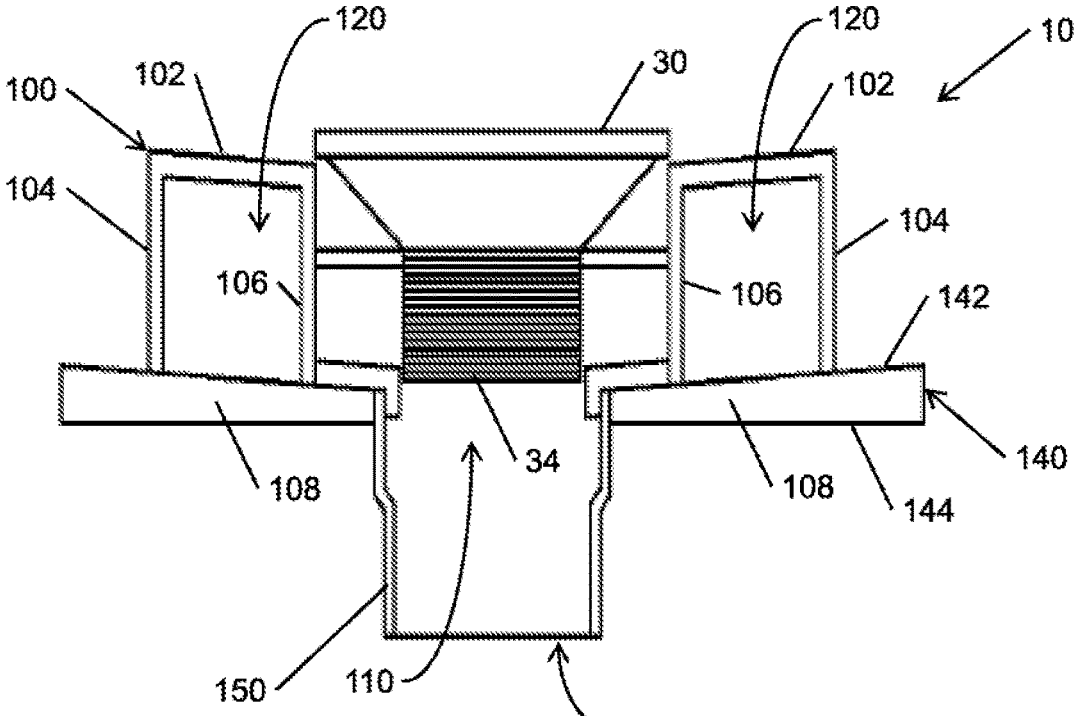
FIG. 4 is a sectional view taken along line 4-4 of FIG. 1.
Figure 5:
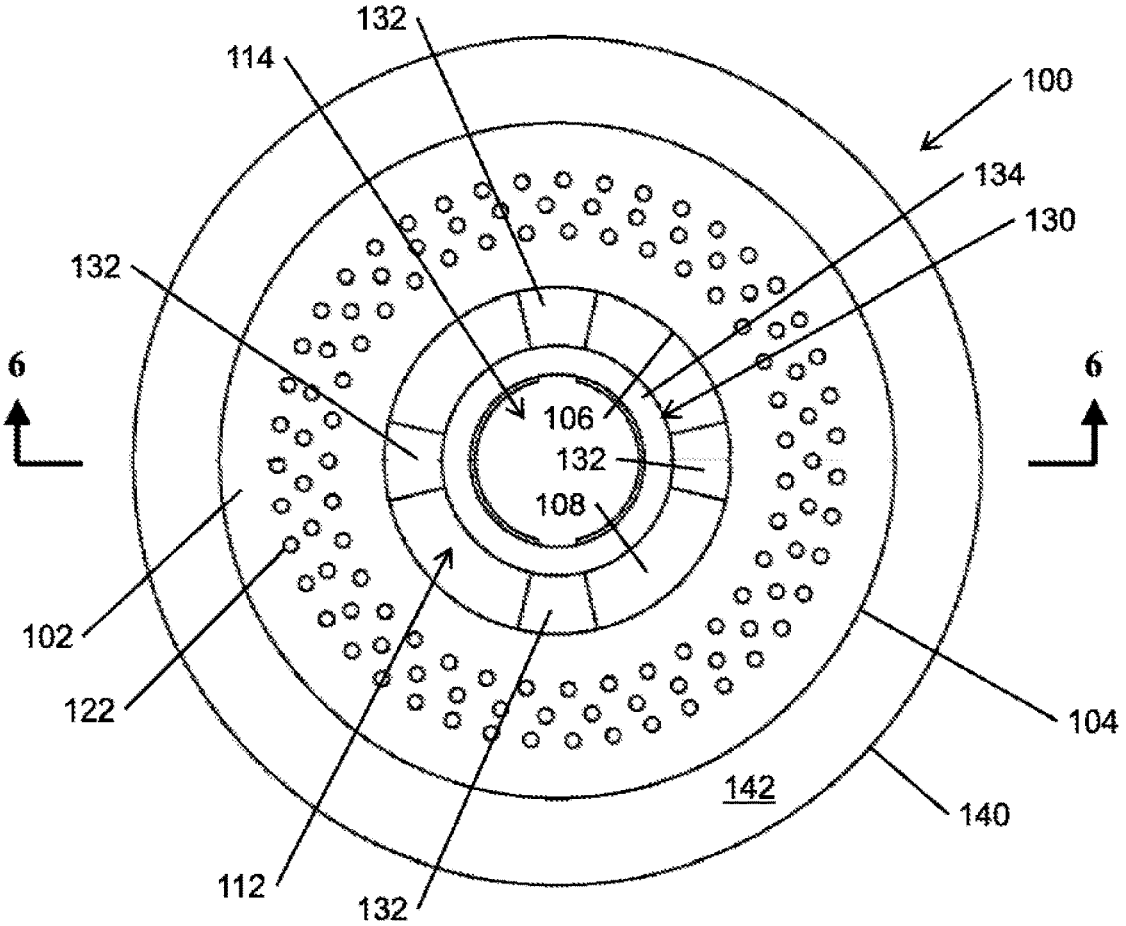
FIG. 5 is a top view of a drain body of a circular tile drain of the present invention.
Figure 6:
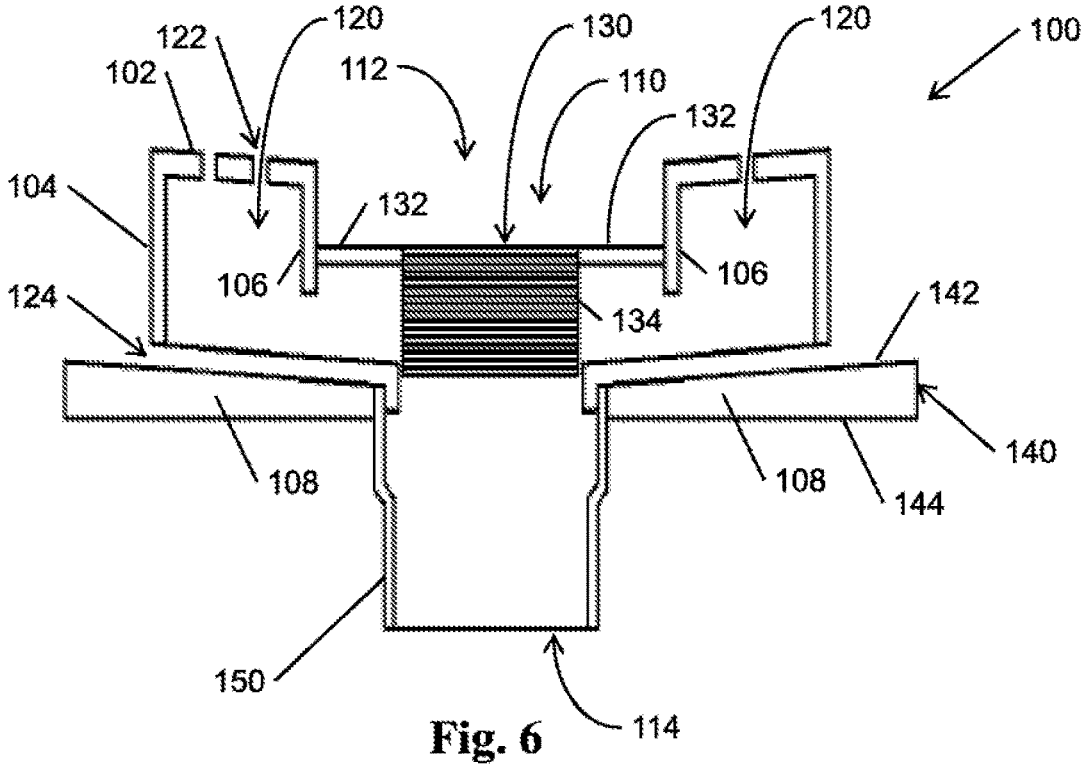
FIG. 6 is a sectional view taken along line 6-6 of FIG. 5.

Referring to FIGS. 4, 5, and 6, a preferred embodiment of the present invention includes a support assembly 130. In some embodiments, the support assembly 130 is positioned at least partially within the interior area 110 of the drain body 100. In some such embodiments, the support assembly 130 includes a support member 134 and one or more support arm 132 extending between the support member 134 and the inner wall 106 of the drain body 100 so as to provide vertical support for the support member 134. In other embodiments, the support assembly 130 includes a support member 134 that is configured to interface with at least part of a drain cover 30, such as with a bottom portion 34 of the drain cover 30, so as to provide vertical support for the drain cover. In some such embodiments, the support member 134 and the bottom portion 34 of the drain cover 30 include corresponding threads such that as the drain cover 30 is rotated relative to the support member 134, the drain cover 30 moves vertically relative to the drain body 100.

Referring to FIGS. 9B, 10B, 10D, 11B, 12B, and 12D, another preferred embodiment of the present invention includes an inner lip 160. In some embodiments, the inner lip is positioned at least partially within the interior are 110 of the drain body 100. In some such embodiments, the inner lip 160 extends from the inner wall 106 and/or the longitudinal wall 194 of the drain body such that the inner wall 106 and/or longitudinal wall 194 provides vertical support for the inner lip 160. In other such embodiments, the inner lip 160 is positioned relatively adjacent to, but slightly displaced downward from, the top opening 112 of the drain body 100. In other embodiments, the inner lip 160 is configured to provide vertical support for a drain cover 30. In some such embodiments, the vertical position of the drain cover relative to the drain body 100 is adjustable by selectively positioning one or more shim between the inner lip 160 and the drain cover 30.

The present invention also pertains to a method of installing a tile drain 10. In some embodiments, the method includes positioning a drain body 100 of the tile drain 10 on a support structure 210. In some such embodiments, a bottom portion 150 of the drain body 100 extends at least partially through the support structure 210 so as to accommodate installing a pipe (not shown), such as a sewer pipe, to the drain body 100. In other such embodiments, a bottom surface 144 of the drain body 100 rests against a top surface of the support structure 210 such that the support structure 210 provides vertical support for the drain body 100.

In some embodiments, a first intermediate layer 220 is installed adjacent to and/or around the drain body 100 of the tile drain 10. In some such embodiments, the first intermediate layer 220 is a standard building material, such as a cement board, having a thickness that is approximately equivalent to a thickness of a bottom lip 140 of the drain body 100. In this way, a top surface of the first intermediate layer 220 is approximately even with a top surface 142 of the bottom lip 140 of the drain body 100.

In preferred embodiments, the method includes creating a bottom waterproofing layer 230 such that fluid positioned above the bottom waterproofing layer 230 is directed to sub weep apertures 124 defined by a drain body 100 of the tile drain 10. In some embodiments, the bottom waterproofing layer 230 extends onto a top surface 142 of a bottom lip 140 of the drain body 100. In some such embodiments, the bottom waterproofing layer 230 creates a barrier so as to prevent and/or otherwise inhibit fluid located above the bottom waterproofing layer 230 from moving through the bottom waterproofing layer 230 towards the support structure 210 and/or away from the sub weep apertures 124.

In other embodiments, a second intermediate layer 240 is installed adjacent to and/or around the drain body 100 of the tile drain 10. In some such embodiments, the second intermediate layer 240 is a standard building material, such as concrete, having a thickness that is approximately equivalent to the height of an outer wall 104 of the drain body 100. In this way, a top surface of the second intermediate layer 240 is approximately even with a top surface of a top wall 102 of the drain body 100.

In other preferred embodiments, the method includes creating a top waterproofing layer 250 such that fluid positioned above the top waterproofing layer 250 is directed to top weep apertures 122 defined by the drain body 100 of the tile drain 10. In some embodiments, the top waterproofing layer 250 is vertically displaced upwards from a bottom waterproofing layer 230 and sub weep apertures 124 formed by the drain body 100. In other embodiments, the top waterproofing layer 250 extends onto a top surface of a top wall 102 of the drain body 100, but not over top weep apertures 122 that are defined by the top wall 102 of the drain body 100. In some such embodiments, the top waterproofing layer 250 creates a barrier so as to prevent and/or otherwise inhibit fluid located above the top waterproofing layer 250 from moving through the top waterproofing layer 250 towards the sub weep apertures 124.

In still other preferred embodiments, the method includes creating a tile layer 260 such that fluid positioned above the tile layer 260 is directed to a top opening 112 defined by the drain body 100 of the tile drain 10. In some embodiments, the tile layer 260 is installed on top of the top waterproofing layer 250, thereby concealing at least part of the top waterproofing layer 250. In other embodiments, the tile layer 260 extends onto a top surface of a top wall 102 of the drain body 100 such that the tile layer 260 conceals top weep apertures 122 that are defined by a top wall 102 of the drain body 100, but not over a top opening 112 of the drain body 100. In some such embodiments, the tile layer 260 creates a barrier so as to prevent and/or otherwise inhibit fluid located above the tile layer 260 from moving through the tile layer 260 towards the top waterproofing layer 250 and/or the top weep apertures 122.

The method of installing a tile drain 10 further includes adjusting the vertical position of a drain cover 30 relative to a drain body 100 of the present invention. In some embodiments, the tile drain 10 is generally circular in shape and includes a drain cover that is generally circular in shape. In other embodiments, the tile drain 10 is generally linear in shape and includes a drain cover 30 that is generally linear in shape. In some such embodiments, the tile drain is symmetrical. In other such embodiments, the tile drain is asymmetrical. In preferred embodiments, the drain cover 30 and the drain body 100 are each configured so as to accommodate positioning a top surface of the drain cover 30 at a desirable position relative to a top surface of the tile layer 260 for a variety of tile thicknesses and configurations.

In some embodiments, the method of adjusting the vertical position of the drain cover 30 includes inserting a portion of the drain cover 30, such as a bottom portion 34 of the drain cover 30, through a top opening 112 of the drain body 100 so as to cause the drain cover 30 to extend at least partially into an interior area 110 of the drain body 100. In some such embodiments, the drain body 100 is configured to selectively interface with the drain cover 30 so as to provide vertical support for the drain cover 30 while accommodating vertical adjustment of the drain cover 30. In other such embodiments, the tile drain 10 includes a support assembly 130 positioned at least partially within the interior area 110 of the drain body 100.

In some embodiments, the support assembly 130 includes a support member 134 that is configured to selectively interface with a bottom portion 34 of the drain cover 30 so as to provide vertical support for the drain cover 30 while accommodating vertical adjustment of the drain cover 30. In some such embodiments, the support member 134 of the support assembly 130 and the bottom portion 34 of the drain cover 30 define corresponding threads such that adjusting the vertical position of the drain cover 30 relative to the drain body 100 can be accomplished by rotating the drain cover 30 relative to the drain body 100. For instance, in some embodiments, the bottom portion 34 of the drain cover 30 defines exterior threads and the support member 134 of the support assembly 130 defines corresponding interior threads.

In some embodiments, the method of adjusting the vertical position of the drain cover 30 includes positioning one or more shim between the drain cover 30 and one or more inner lip 160 of the drain body 100. In some such embodiments, such as when the tile drain 10 is a circular tile drain 10, the inner lip 160 extends from a continuous inner wall 106. In other such embodiments, such as when the tile drain 10 is a symmetrical linear tile drain 10, an inner lip 160 extends inward from each of two opposed inner walls 106. In still other such embodiments, such as when the tile drain 10 is an asymmetrical linear tile drain 10, a first inner lip 160 extends inward from an inner wall 106 and a second inner lip 160 extends inward from an opposed longitudinal wall 194.

In some embodiments, such as when the tile drain 10 is a linear tile drain 10, the method of installing a tile drain 10 further includes adjusting the length of the tile drain 10. In some such embodiments, the method includes cutting a longitudinal portion 190 of the drain body 100 so as to define a new distal end 192 of the longitudinal portion 190, thereby changing the length of the drain body 100. In other such embodiments, the method includes coupling an end cap 20 to the distal end 192 of the longitudinal portion 190 and sealing the end cap 20 to the distal end 192 of the end cap 20.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall within the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A tile drain comprising:

a drain body defining a drain opening and comprising a top wall and an outer wall, said top wall extending at least partially between said drain opening and said outer wall;

said tile drain further defining a drain cover leading to said drain opening, a vertical position of the drain cover being vertically adjustable relative to a vertical position of said top wall; and wherein said drain body is configured to be embedded within a tile floor such that tiles of a tile layer extend over and overlay at least a portion of said top wall.

2. The tile drain of claim 1, wherein:

said drain body further comprises an inner lip extending from an inner wall of said drain body partially within said drain opening; and a shim configured for placement between said inner lip and said drain cover for vertical adjustment of said drain cover relative to said vertical position of said top wall.

3. The tile drain of claim 1, wherein vertical adjustment of the drain cover relative to the top wall is accomplished by:

engaging a drain cover of the tile drain with said drain body of the tile drain; and positioning the drain cover of the tile drain relative to a top surface of the tile layer, the tile layer extending at least partially over the drain body.

4. The tile drain of claim 1, wherein:

said drain body is generally linear in shape having opposing first and second ends; and said tile drain is configured to be length adjustable by removing a portion of said first end to a desired size forming an adjusted first end and thereby changing the length of the tile drain.

5. The tile drain of claim 4, further comprising:

an end cap configured for selective coupling to said drain body adjusted first end to seal said drain body to prevent fluid from escaping said drain body through said adjusted first end.

6. A tile drain comprising:

a drain body defining a drain opening and comprising a top wall and an outer wall, said top wall extending at least partially between said drain opening and said outer wall;

said tile drain further defining a drain cover leading to said drain opening, a vertical position of the drain cover being vertically adjustable relative to a vertical position of said top wall;

said drain body further comprises an inner lip extending from an inner wall of said drain body partially within said drain opening; and a shim configured for placement between said inner lip and said drain cover for vertical adjustment of said drain cover relative to said vertical position of said top wall.

* * * * *